United States Patent [19]

Oka et al.

[11] Patent Number: 4,785,331

[45] Date of Patent: Nov. 15, 1988

[54] ELECTROPHOTOGRAPHIC COPYING METHOD AND APPARATUS

[75] Inventors: Tateki Oka; Naoki Toyoshi; Tomoaki Yokoyama, all of Aichi, Japan

[73] Assignee: Minolta Camera Kabushiki Kaisha, Azuchi, Japan

[21] Appl. No.: 117,836

[22] Filed: Nov. 9, 1987

[30] Foreign Application Priority Data

Nov. 13, 1986 [JP] Japan ..... 61-270598
Nov. 13, 1986 [JP] Japan ..... 61-270599

[51] Int. Cl.[4] ..... G03G 15/06

[52] U.S. Cl. ..... 355/14 D; 355/3 DD; 355/77; 118/689

[58] Field of Search ..... 355/14 D, 3 DD, 14 R, 355/77, 14 CH; 118/688, 689, 690, 691

[56] References Cited

U.S. PATENT DOCUMENTS 3,967,891 7/1976 Rippstein ..... 355/3 R
4,346,982 8/1982 Nakatima et al. ..... 355/3 R
4,416,535 11/1983 Tottori ..... 355/14 D
4,480,909 11/1984 Tsuchiya ..... 355/14 CH
4,522,481 6/1985 Imai et al. ..... 355/14 D
4,551,005 11/1985 Koichi ..... 355/14 D
4,572,654 2/1986 Murai et al. ..... 355/14 D
4,618,249 10/1986 Minor ..... 355/14 CH
4,636,060 1/1987 De Schamphelaere et al. ..... 355/14 CH
4,639,117 1/1987 Murai et al. ..... 355/14 D
4,657,377 4/1987 Takahashi ..... 355/14 D

FOREIGN PATENT DOCUMENTS 51-134635 11/1976 Japan .
54-30833 3/1979 Japan .

*Primary Examiner*—R. L. Moses
*Attorney, Agent, or Firm*—Wenderoth, Lind and Ponack

[57] ABSTRACT

An electrophotographic copying apparatus is capable of forming outline images. It comprises a first charging device, an exposing device, a second charging device and a developing device along a moving direction of a photoconductor. A sensor detects an amount of toner adhering to a reference image formed on the surface of the photoconductor. Supply of toner is controlled based on the detected amount. In an outline image forming mode, an amount of toner to be supplied is set to a value smaller than an amount in a standard image forming mode.

18 Claims, 12 Drawing Sheets

ELECTROPHOTOGRAPHIC COPYING METHOD AND APPARATUS

BACKGROUND OF THE INVENTION

1. Field of the Invention

This invention relates to an electrophotographic copying method and apparatus. More specifically, it relates to an electrophotographic copying method and apparatus for forming outline images corresponding to peripheral outlines of document's images.

2. Description of the Prior Art

Generally speaking, the peripheral outline of an image is in practice full of necessary information thereabout and represents sufficiently the characterizing features of the given image, thus playing among others a most important role in the judgement of the latter.

The so-called outline image forming means is adapted such that a peripheral outline is picked up from a generally full and positive documentary image and is devoid of intermediate tones or reversely, solid representations, thus being most effective for the identification of the practical image and for pattern recognition purpose thereof.

For example, complex color image patterns can be obtained by such outline image forming means in a manner of forming by execution of successive copying operations a blank pattern encircled by a color outline, or preparing a blank pattern for later producing differently colored local image areas contained therein.

It should be noted that in the name of the present assignee company per se, it has already been proposed to realize an outline image forming process, wherein, in the mono-component type toner developing method using conductive toner to develop static latent images, a DC bias voltage is applied between the material to be subjected to developing and the carrier for the conductive toner, said voltage being at a medium potential ranged between maximum and minimum surface potentials of said material and having an opposite polarity to that of the static latent image charge, thereby to extract the outline marginal configuration only from the latent image on said material to be developed (refer to Japanese Patent Laying-Open Gazette No. 134635/1976).

It should be further noted, however, that there is a considerable drawback in the above mentioned prior art process. In this proposed process, the developed marginal outline image is only of negative one, because the marginal outline of the static latent image is also negative and the conductive toner will be deposited onto substantive part of the latent image devoid of the marginal outline thereof, and indeed, by virtue of higher potential difference at the substantive part of the latent image on the drum. In practice, however, a desired marginal outline should preferably be in black and thus positive. Therefore, the thus formed negative outline image must generally be subjected to a further reproducing step relying upon the reverse development principle, which represents naturally a considerable and troublesome drawback inherent in the above mentioned known process.

Under the circumstances, the inventors of the present invention have proposed electrophotographic copying methods in which a second charger is provided between an exposure device and a developing device and an outline image is obtained by operation of the second charger, as disclosed in the U.S. patent application Ser. Nos. 16,716 (filed Feb. 19, 1987), 16,717 (filed Feb. 19, 1987) and 58,266 (filed May 21, 1987). In those methods, a normal copy image can be obtained if the second charger is turned off. On the other hand, if copy operation is performed with the second charger being turned on, an electrostatic latent image formed on the photoconductor is processed as an outline image prior to a process of the developing device and thus the outline image can be obtained.

In general, developer obtained by mixing carrier and toner at a fixed ratio is used to develop an electrostatic latent image. In order to obtain an image of good quality, it is necessary to supply toner in compensation for an amount of toner consumed by development.

Consequently, the above mentioned proposed methods adopt a control method for toner supply to a developer tank, as described below. A toner density sensor is provided in a cleaning device or the like adjacent to a central portion of a photoconductor drum and a reference latent image at a given potential is formed and developed on the surface of the photoconductor drum prior to formation of an image of an original. Then, a toner density corresponding to an amount of toner adhering to the reference latent image is detected by the toner density sensor and a toner supply roller or the like is driven based on the detected value, so that the toner density of the developer in the developer tank can be maintained constant.

However, if the above mentioned toner density control method is used in a copying apparatus capable of forming an outline image using the above mentioned second charger, the following problems would occur.

In the above mentioned toner density control method, it is necessary to form a reference latent image at a given potential on the surface of the photoconductor drum and if the reference latent image is formed at the time of copy operation in an outline image forming mode, the potential of the reference latent image is lowered except for that in the outline portions due to the charging effect of the second charging device. As a result, if the reference latent image is developed, little amount of toner adheres to the image (except for the outline portions) and the toner density sensor erroneously detects a low toner density irrespective of a real toner density, thereby to instruct unnecessary supply of toner. If such unnecessary supply of toner is continued, the developer in the tank has an excessive amount of toner, which would cause stains on an image or fine splashes of toner to soil components around the developing device.

SUMMARY OF THE INVENTION

An object of the present invention is to provide an electrophotographic copying method and apparatus in which if copy operation is continued in an outline image forming mode, excess of toner will never occur and it is made possible to prevent disadvantages such as stains on an image or soiling of the equipment surrounding the developing device by splashes of toner.

The present invention comprises an electrophotographic copying apparatus comprising: an electrostatic latent image bearing member; first charging means for charging the electrostatic latent image bearing member; exposing means for exposing the charged electrostatic latent image bearing member to light reflected from an original, thereby to form an electrostatic latent image thereon; second charging means for recharging the electrostatic latent image bearing member on which the electrostatic latent image is formed to obtain an outline image; developing means for developing the electrostatic latent image; means for forming a reference image on the electrostatic latent image bearing member; detecting means for detecting the amount of toner adhering to said reference image; mode designating means for designating either a first copying mode in which said charging means is not operated or a second copying mode in which said second charging means is operated; first control means for controlling an amount of toner to be replenished to the developing means according to the result of detection of the detecting means, when the first copying mode is designated; and second control means for controlling the amount of toner to be replenished to the developing means to cause the amount to be smaller than the amount determined according to the result of detection of the detecting means, when the second copying mode is designated.

Preferably, the amount of toner in the case of designation of the second copying mode comprises zero. More preferably, the amount of toner in the case of designation of the second copying mode is predetermined and fixed. More specifically, the amount of toner in the case of designation of the second copying mode is about 20 mg. In addition, the second control means comprises timer means for computing time when toner is replenished to the developing means.

More specifically, the second charging means has a scorotron-charger provided with a grid. The scorotron-charger has a polarity opposite to that adopted by the first charging means. The grid is charged with a voltage which is sufficiently lower than the surface potential in an image area of the latent image and slightly higher than the surface potential in a non-image area of the latent image with the same polarity as that of the first charging means so that only the outline portion has a higher potential. The developing means is supplied with a bias voltage which is slightly higher than the grid voltage when the second copying mode is designated. The first control means replenishes toner to the developing means when the toner amount detected by the detecting means falls below a reference toner amount.

In another concrete example, the scorotron-charger is supplied with an AC voltage. The grid is charged with a voltage which is sufficiently lower than the surface potential in an image area of the latent image and slightly higher than the surface potential in a non-image area of the latent image with the same polarity as that of the first charging means so that only the outline portion has a higher potential.

In a further concrete example, the scorotron-charger is supplied with the same polarity as that adopted by the first charging means. The grid is charged with a voltage which is slightly lower than the surface potential in a image area of the latent image and sufficiently higher than the surface potential in a non-image area of the latent image with the same polarity as that of the first charging means so that only the outline portion has a lower potential.

The present invention comprises an electrophotographic copying method comprising: a first charging step of charging an electrostatic latent image baring member; an exposing step of exposing the charged electrostatic latent image bearing member to light reflected from an original, thereby to form an electrostatic latent image thereon; a second charging step of recharging the electrostatic latent image bearing member on which the electrostatic latent image is formed to obtain an outline image; a developing step of developing the electrostatic latent image; a step of forming a reference image on the electrostatic latent image bearing member; a detecting step of detecting an amount of toner adhering to the reference image; a mode designating step of designating either a first copying mode in which the second charging step is not applied or a second copying mode in which the second charging step is applied; a first control step of controlling an amount of toner to be replenished for the developing step according to the result of the detecting step, when the first copying mode is designated; and a second control step of controlling the amount of toner to be replenished for the developing step, to cause the amount to be smaller than the amount determined according to the result of the detecting step, when the second copying mode is designated.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
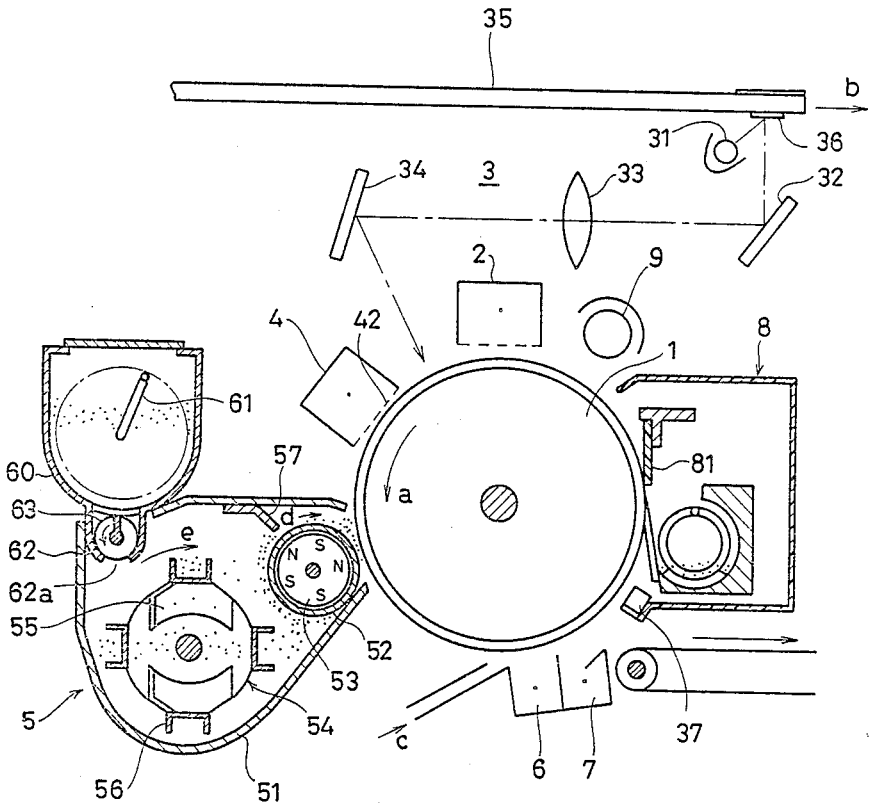
FIG. 1 is a view showing a construction of an electrophotographic copying apparatus of an embodiment of the present invention.

FIG. 1 shows an electrophotographic copying apparatus of an embodiment of the present invention. An electrophotographic photoconductor drum 1 is of a well-known type having an photoconductor layer on its outer surface. This photoconductor drum 1 is driven to rotate in a direction shown by the arrow a. The following members and devices are provided around the drum 1.

An electrification charger 2 functions as a first charging device for applying electric charge of a predetermined potential (electric charge of a positive polarity in this embodiment) to the surface of the photoconductor drum 1.

An exposure device 3 applies light to an original placed on a document glass table 35 which can be scanned in a direction shown by the arrow b, whereby an electrostatic latent image corresponding to an original image is formed on the surface of the photoconductor drum 1 by a well-known slit exposure system. The exposure device 3 comprises an exposure lamp 31, a mirror 32, a projection lens 33 and a mirror 34.

A scorotron-charger 4 functions as a second charging device for recharging the surface of the photoconductor drum 1 on which the electrostatic latent image is formed by the exposure device 3. A developing device 5 develops the electrostatic latent image formed on the surface of the photoconductor drum 1, by using a magnetic brush system, whereby a visible toner image is obtained. The scorotron-charger 4 and the developing device 5 will be described in detail afterwards.

A transfer charger 6 applies an electric field to a back surface of a sheet of copy paper transferred in a direction shown by the arrow c, whereby the toner image formed on the surface of the photoconductor drum 1 by the developing device 5 is transferred onto the copy paper.

A separation charger 7 applies an AC electric field to the copy paper having the transferred image to remove the electric charge from the copy paper, whereby the copy paper is separated from the surface of the photoconductor drum 1.

A cleaning device 8 is of a blade type and removes the residual toner on the surface of the photoconductor drum 1. An eraser lamp 9 removes the electric charge remaining on the surface of the photoconductor 1 by applying light thereto whereby the photoconductor drum 1 is prepared for the subsequent copy process.

Figure 6:
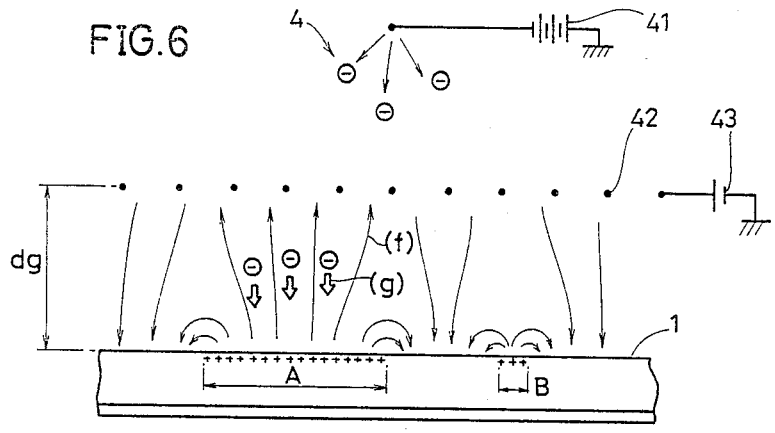
FIG. 6 is a typical illustration of electric force lines of a second charging device.

The scorotron-charger 4 functioning as the second charging device as described above has a charge wire connected to a DC power supply 41 as shown in FIG. 6. A grid 42 is connected to a power supply 43. In this embodiment in which a positive outline latent image is formed by exposure of a positive original image, the charge wire is supplied with a voltage of a polarity opposite to that of a voltage applied to the electrification charger 2. The grid 42 is supplied with a voltage sufficiently lower than a surface potential of a electrostatic latent image area and slightly higher than a surface potential of a non-image area, that voltage being of the same polarity as that of the voltage applied to the electrification charger 2 from the power supply 43.

The developing device 5 comprises a developer tank 51 including a developing sleeve 52 and a bucket roller 54, as well as a toner supply tank 60 on the developer tank 51. The developing sleeve 52 is adjacent to the photoconductor drum 1 and is rotated in a direction shown by the arrow d. The developing sleeve 52 is connected to a developing bias power supply not shown. A magnetic roller 53 having a plurality of N and S poles is fixed in a non-rotatable manner inside the developing sleeve 52.

Developer is mixture of magnetic carrier and insulating toner, which are charged with opposite polarities by friction charging. In this embodiment, the insulating toner is charged with a polarity opposite to that of the electrification charger 2. If the insulating toner is not magnetized, a developing bias voltage slightly higher than the voltage of the grid and having the same polarity as that of the electrification charger 2 is applied to the developing sleeve 52. In the case of this embodiment, the value of the developing bias voltage is set to a value slightly higher than the surface potential of the central portion of the electrostatic latent image area where potential is lowered by corona discharge of the scorotron-charger 4, in a second charging step to be described afterwards. The developer is held in a brush form on the surface of the developing sleeve 52 by magnetic force of the magnetic roller 53. The thickness of the toner is regulated by a regulator plate 57 when the developing sleeve 52 rotates in the direction of the arrow d to feed the toner, so that the electrostatic latent image formed on the surface of the photoconductor drum 1 is developed.

The bucket roller 54 is driven to rotate in a direction shown by the arrow e. It has agitation blades 55 for mixing developer, and buckets 56 on its surface for scooping up developer to feed it to the surface of the developing sleeve 52.

Figure 2:
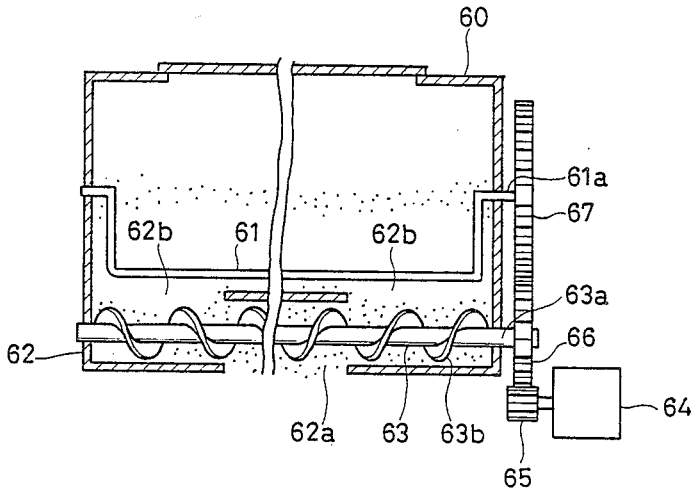
FIG. 2 is a sectional view of a developing device.
Figure 3:
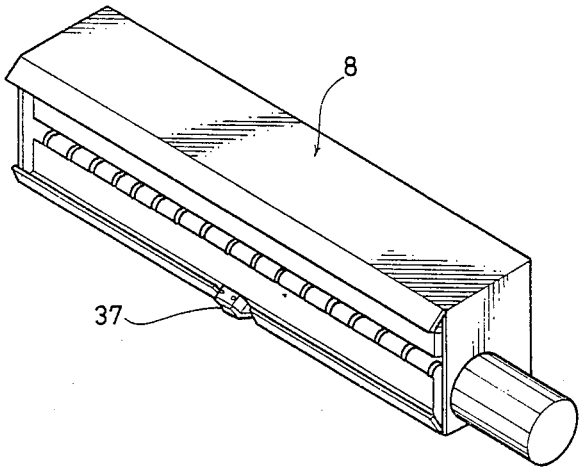
FIG. 3 is a perspective view of a cleaning device.

The toner supply tank 60 has an agitation bar 61 to be rotated for preventing bridging or blocking of toner, as shown in detail in FIG. 2. A bottom portion of the toner supply tank 60 is provided with a supply portion 62 having a supply opening **62*a*. The supply portion 62 communicates with the supply tank 60 through openings 62*b*. The supply portion 62 has a rotatable toner supply roller 63 including a shaft 63*a* and a spiral blade 63*b* on the shaft. The spiral blade 63*b* is twisted in opposite directions regarding the central portion of the shaft as a boundary, so that toner is brought together toward the central portion. The toner supply roller 63 and the agitation bar 61 are rotated in synchronism with the motor 64. More specifically, an output gear 65 of the motor 64 is engaged with a gear 66 fixed at an end portion of the shaft 63*a* of the toner supply roller 63, and the gear 66 is engaged with a gear 67 fixed at an end portion of the shaft 61*a* of the agitation bar 61. Thus, toner in the supply tank 60 is fed from the supply opening 62*c* into the developer tank 51 by rotation of the tone supply roller 63**.

The supply of toner is controlled by an automatic toner supply device. More specifically, a density sensor 37 of a reflection type provided in a lower end portion of the cleaning device 8, opposed to the central portion of the photoconductor drum 1 detects an amount of toner adhering to the reference image of a fixed potential formed on the surface of the photoconductor drum 1 prior to a copy process. The supply of toner is controlled based on the detected value. The reference image is formed by applying exposure to a reference chart 36 in black provided a little distant (in the direction of the arrow b) from an original edge placing portion of the glass table 35.

Figure 4:
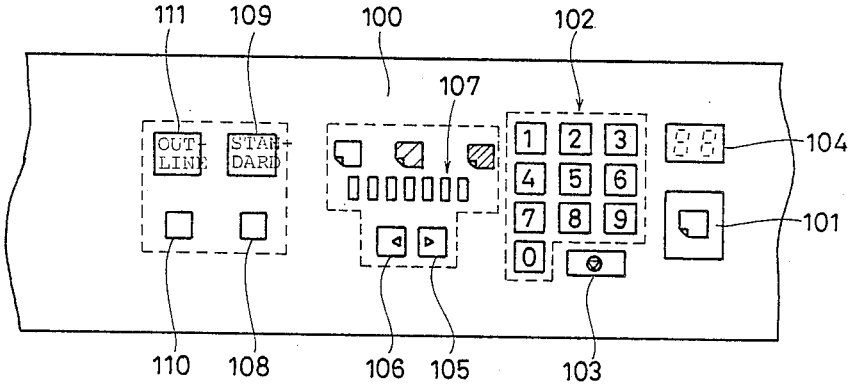
FIG. 4 is a plan view of an operation panel.

FIG. 4 shows an operation panel 100 of the copying apparatus of this embodiment. This operation panel 100 comprises a print key 101, ten keys 102 for numerals 1 to 9 and 0, a clear/stop key 103 and a display portion 104 for indicating the number of copies or the like. This panel further comprises an up-key 105 and a down-key 106 for adjustment of image density, and a display LED group 107 for indicating the image density. The panel further comprises a standard copy mode selection key 108, an LED display 109 for indicating the selection of the key 108, an outline image forming mode selection key 110, and an LED display 111 for indicating the selection of the key 110.

Figure 5:
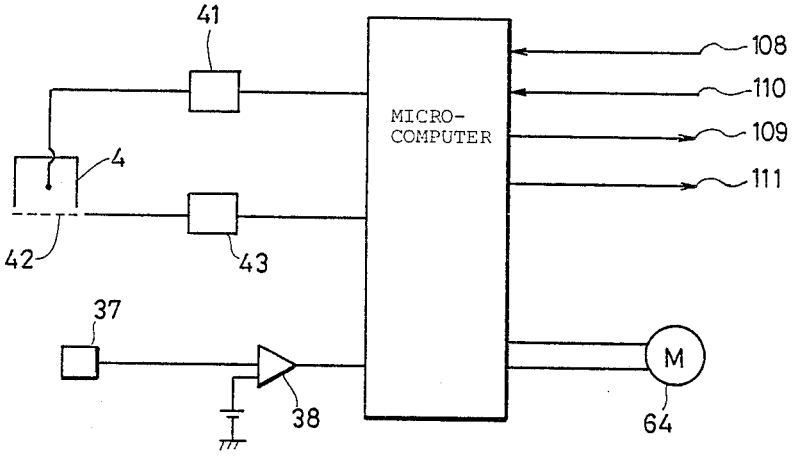
FIG. 5 is a block diagram of a control circuit.

FIG. 5 shows a control circuit of the copying apparatus of this embodiment. Control operation in the control circuit is performed by a microcomputer as the control center. More specifically, on and off signals of the mode selection keys 108 and 110 are inputted to the microcomputer and the microcomputer outputs the on and off signals to the LED displays 109 and 111, and to the toner supply motor 64. The microcomputer further outputs on and off signals to the scorotron-charger 4, and to the power supplies 41 and 43 of the grid 42 to instruct turn-on and turn-off thereof. In addition, a detection signal from the toner density sensor 37 is inputted to a comparator 38 as a voltage value, so as to be compared with a reference value. Then, a signal indicating that it is higher or lower than the reference value is inputted to the microcomputer.

Polarities and voltage in the respective chargers etc. in this embodiment are as follows.

Electrification charger: power supply voltage positive polarity, +5.5 kV

Scorotron-Charger: voltage from the power supply 41 negative polarity, −6.0 kV Grid: voltage from the power supply 43 positive polarity, +200 V Surface distance (dg) between grid and photoconductor: 1.5 mm Developing bias supply: power supply voltage positive polarity, +300 V Transfer charger: power supply voltage positive polarity, +5.5 V Non-magnetized insulating toner: negative polarity Those polarities may be all reversed and, needless to say, the voltage values are indicated only by way of example.

Now, a method of forming an image by the above described copying apparatus will be described according to the order of steps in the respective modes.

I. Outline image forming mode:

Operation in this outline image forming mode is executed when the above mentioned selection key 110 is turned on.

(i) First charging step

Electric charge of a predetermined potential is applied to the surface of the photoconductor drum 1 by means of the electrification charger 2. As a result, the surface potential of the photoconductor drum 1 in this embodiment becomes +600 V.

(ii) Exposure step

Figure 7A:
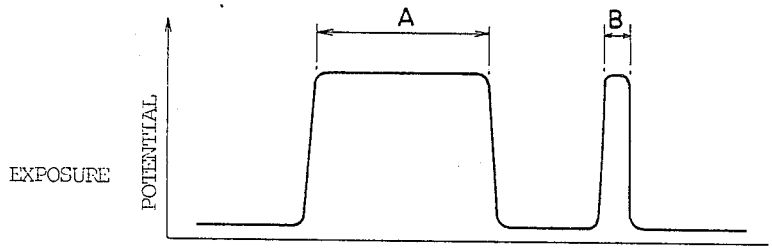
FIGS. 7A to 7C are graphs showing potentials of an electrostatic latent image in image forming steps.

The surface of the photoconductor drum 1 charged with the potential of +600 V is exposed in a slit manner to receive a positive original image, whereby an electrostatic latent image is formed thereon. In this case, as shown in FIGS. 6 and 7A, the electric charge in the portions crrresponding to the image areas A and B remains as the potential of +600 V and the electric charge in the portion corresponding to the non-image areas is lowered to +100 V as a result of irradiation of light.

(iii) Second charging step

The surface of the photoconductor drum 1 on which the electrostatic latent image is formed is recharged by the scorotron-charger 4 to which −6.0 kV is applied from the power supply 41. At this time, a voltage of +200 V is applied from the power supply 43 to the grid 42. The voltage applied to the scorotron-charger 4 has a polarity opposite to that of the voltage applied to the electrification charger 2. The voltage applied to the grid 42 has the same polarity as that of the voltage applied to the electrification charger 2. The voltage applied to the grid 42 is sufficiently lower than the surface potential (+600 V) of the electrostatic latent image areas A and B and slightly higher than the surface potential (+100 V) of the non-image areas.

Electric force lines as shown by arrows f in FIG. 6 are formed between the surface of the photoconductor drum 1 and the grid 42. Ions of the negative polarity generated from the charge wire are subjected to conveying forces along the electric force lines. In this case, the electric force lines for directing the negative ions near the grid 42 toward the surface of the photoconductor drum 1 are generated only in a portion of the surface image area A excluding the inner outline portions A' (that is, only in the central portion). Accordingly, the negative ions attain only the central portion of the surface image area A as shown by the arrows g and the electric charge in this area is removed to cause the potential of this area to be lowered to a potential almost equal to the grid voltage (+200 V) (as shown in FIG. 7B).

Figure 7B:
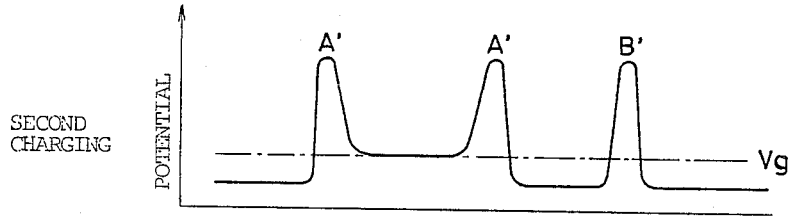

More specifically, with regard to the surface potential of the photoconductor drum 1, the surface potential of the areas not containing the electrostatic latent image remains almost as low as +100 V, as shown in FIG. 7B. The inner outline portions A' and B' of the image areas A and B remain as high-potential portions of about +600 V with a predetermined width, equal to the initial surface potential. The potential of the central portion of the surface image area A is lowered to a value almost equal to the grid voltage (Vg: +200 V). The surface potential in the strip-shaped image outline portion B' is scarcely lowered but a width of the charged area is a little decreased.

Thus, in this second charging step, the outline portions of the image areas A and B are formed as a positive electrostatic latent image.

(iv) Developing step

Figure 7C:
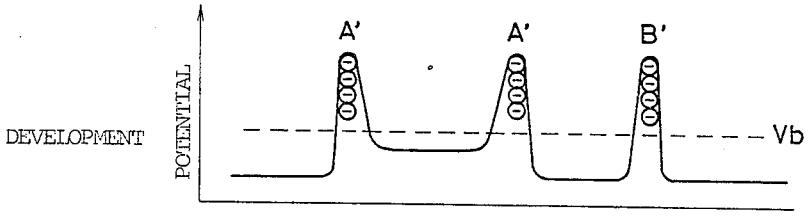

The electrostatic latent image formed as the positive image of the outline portions in the second charging step is developed by the developing device 5. In this embodiment, a development bias voltage of +300 V is applied to the developing sleeve 52. This developing bias voltage has the same polarity as that of the voltage applied to the electrification charger 2 and is a value vb slightly higher than the surface potential of the central portion of the surface image area A lowered in the second charging step, as shown in FIG. 7C, so that toner can be prevented from adhering to the central portion of the surface image area A as well as to the non-image area, thereby to avoid fogging in those areas.

As a result, the insulating toner charged with the negative polarity adheres to the high-potential portions of the photoconductor drum 1, that is, the inner outline portions A' and B' of the image areas A and B, respectively, and thus a toner image having only inner outlines is formed in the regular developing step.

This toner image is transferred onto copy paper by discharge of the positive polarity b the transfer charger 6, whereby a copy image is formed by means of the fixing device not shown.

II. Standard copy mode:

Operation in this standard copy mode is executed when the above mentioned selection key 108 is turned on. In addition, this standard copy mode is preset at the time of initialization for control, for example, at the time of turn-on of the power supply.

(i) First charging step

The first charging step in the standard copy mode is applied in the same manner as in the case of the above described outline image forming mode.

(ii) Exposure step

This step is applied in the same manner as in the case of the above described outline image forming mode and a positive electrostatic latent image shown in FIG. 7A is formed.

(iii) Second charging step

The power supplies 41 and 43 are both turned off and the scorotron-charger 4 is not operated. Accordingly, the positive electrostatic latent image formed in the exposure step is immediately subjected to the subsequent developing step.

(iv) Developing step

This step is applied in the same manner as in the case of the above described outline image forming mode. In this step, the insulating toner charged with the negative polarity adheres to the image areas A and B shown in FIG. 7A and an ordinary toner image corresponding to an original image with a ratio of 1:1 is formed regularly. In this case, the developing bias voltage can be changed to +230 V.

Now, referring to the flow charts of FIG. 8 et seq., control procedures by the microcomputer will be described in the following.

Figure 8:
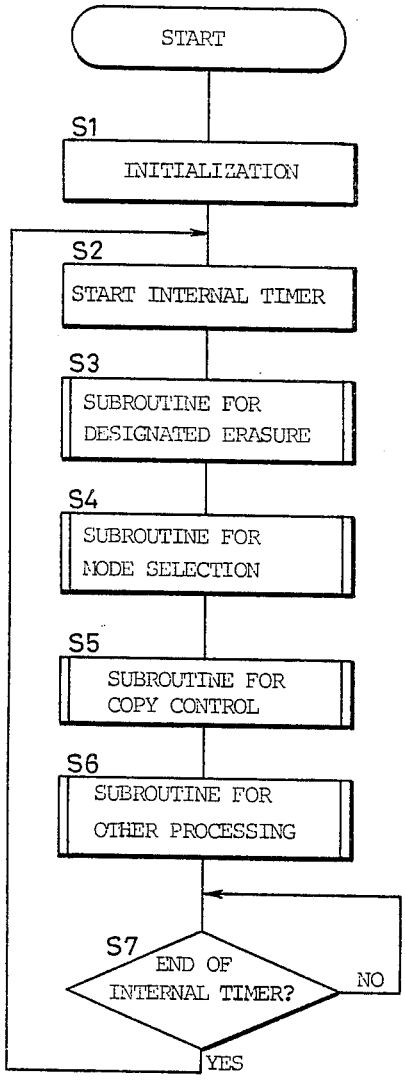
FIGS. 8 to 11 are flow charts showing control procedures.

FIG. 8 shows a main routine of the microcomputer.

When power supply is turned on, the microcomputer is initialized and the program starts. First, in the step S1, the RAM is cleared and the registers and the devices are initialized. Then, in the step S2, an internal timer is started. This internal timer determines a period of one cycle of the main routine irrespective of contents of processing in subroutines to be described afterwards. The value of the internal timer is set in the step S1.

Subsequently, subroutines of the steps S3 to S6 are successively called. When processing in all of the subroutines is completed, the microcomputer waits for an end of the internal timer in the step S7 and then the program returns to the step S2. Using this length of one routine, various timers in the subroutines perform counting operation.

Processing of the subroutine in the step S3 is executed to remove electric charge from the photoconductor drum 1 in a designated erasure step. A detailed description of this step is omitted since it is not related with the present invention.

In the subroutine in the step S4, a copy mode is set by turning on or off the mode selection keys 108 and 110 on the operation panel 100 and the selection of the copy mode is displayed on the operation panel 100. This step will be described in detail afterwards.

The subroutine in the step S5 relates to copy control. In this step, copy operation in a copy mode selected in the step S4 by turn-on of the print key 101 is executed. In this case, if any of the keys on the operation panel 100 is not turned on within a predetermined period after an end of copy operation in the outline image forming mode, the copy mode automatically returns to the standard copy mode. This will be described in detail afterwards.

The subroutine in the step S6 relates to other processing such as adjustment of fixation temperature. This step will be described in detail afterwards.

Figure 9:
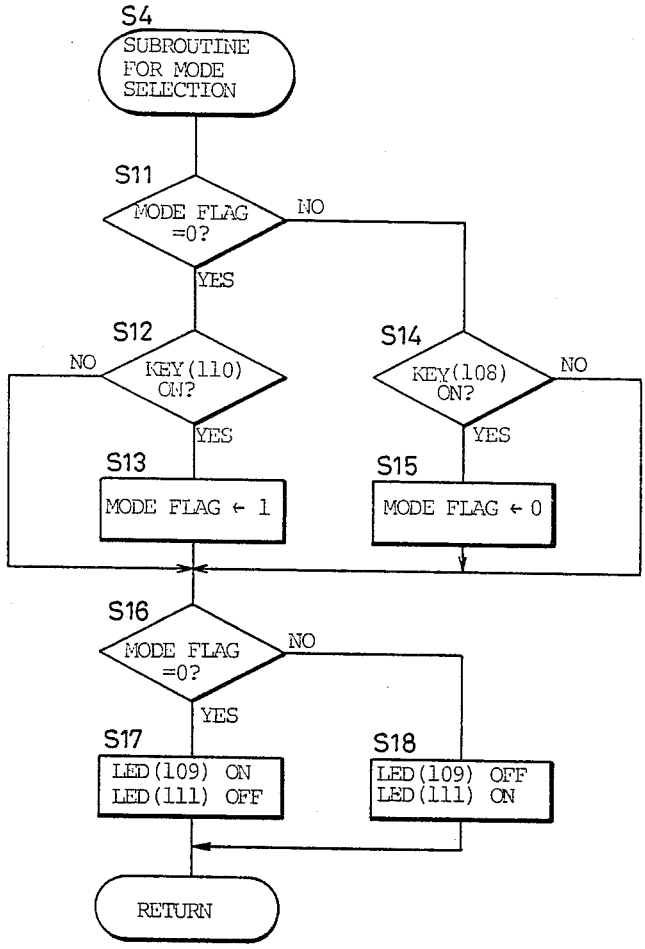

FIG. 9 shows the subroutine for mode selection in the step S4. First, it is determined in the step S11 whether a mode flag is reset to 0 or not. If it is 0, the program proceeds to the step S12. If it is 1, the program proceeds to the step S14.

It is determined in the step S12 whether the outline image forming mode selection key 110 is turned on or not. If it is turned on, the mode flag is set to 1 in the step S13. In the step S14, it is determined whether the standard copy mode selection key 108 is turned on or not. If it is turned on, the mode flag is reset to 0 in the step S15. Thus, if either of the mode selection keys 108 and 110 is turned on, the copy mode of the key turned on is set. At the time of turn-on of the power supply, the mode flag is reset to 0 in the step S1 and the standard copy mode is set even if the selection key 108 is not turned on.

Then, in the step S16, it is determined whether the mode flag is 0 or not. If the mode flag is 0, that is, if the standard copy mode is selected, the standard copy mode display LED 109 is turned on and the outline image forming mode display LED 111 is turned off in the step S17. Then, the program returns to the main routine. On the other hand, if the mode flag is not 0, that is, if the outline image forming mode is selected, the LED 109 is turned off and the LED 111 is turned on in the step S18, and then the program returns to the main routine.

Figure 10:
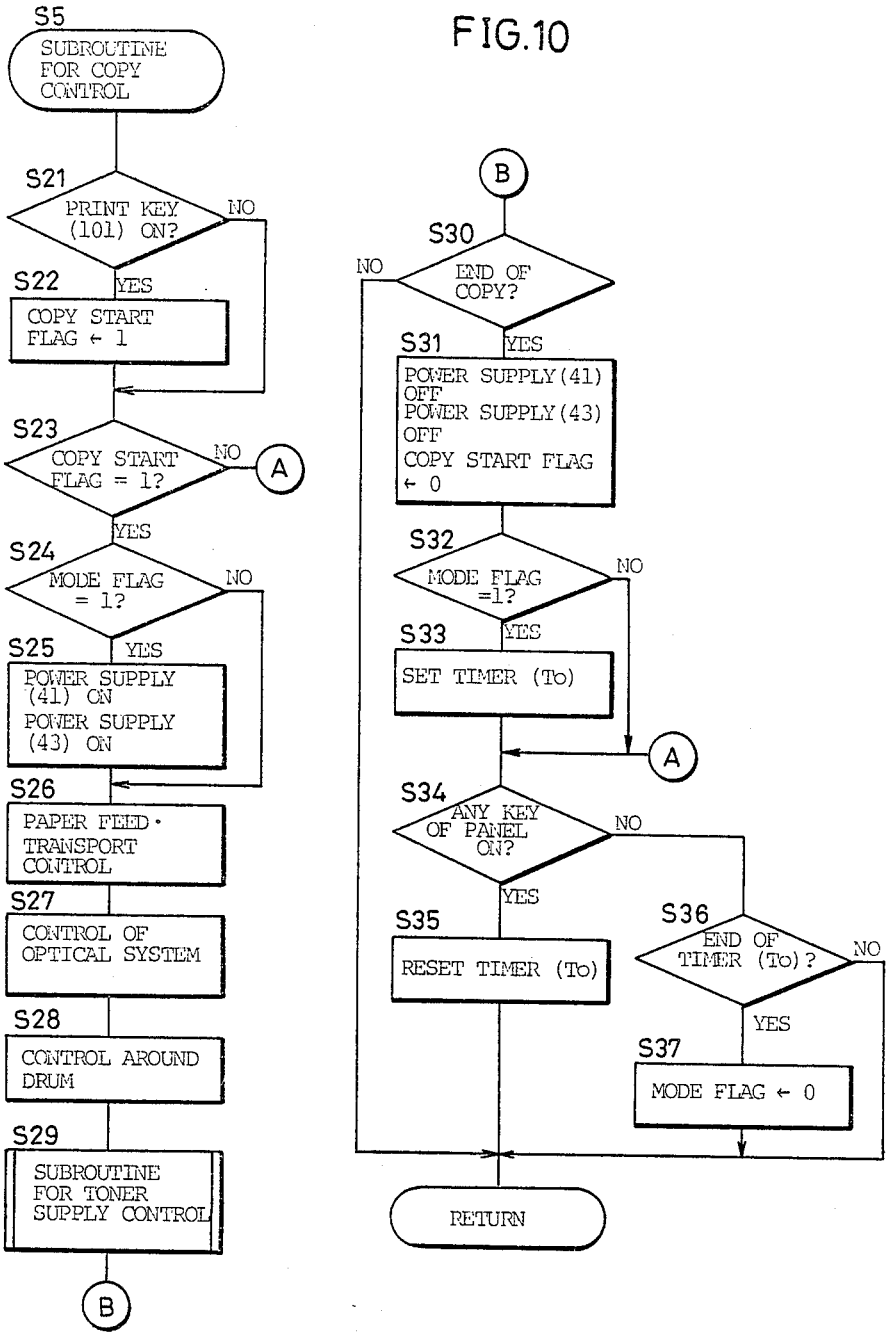

FIG. 10 shows the subroutine for copy control in the step S5.

First, it is determined in the step S21 whether the print key 101 is turned on or not. If it is not turned on, the program proceeds to the step S23. If it is turned on, the copy start flag is set to 1 in the step S22 and the program proceeds to the step S23. Thus, the copy start flag is set to 1 when the print key 101 is turned on, and it is reset to 0 in the step S31 when copy operation is completed.

Then, it is determined in the step S23 whether the copy start flag is 1 or not. If it is reset to 0, the program proceeds to the step S34 described afterwards. If it is set to 1, it is determined in the step S24 whether the mode flag is set to 1, that is, the outline image forming mode is selected. If it is selected, then in the step S25, the power supply 41 of the scorotron-charger and the grid power supply 43 are turned on. If the standard copy mode is selected, those power supplies are turned off.

Subsequently, feeding and transport of paper are controlled in the step S26. The optical system 3 is controlled in the step S27. The chargers, the developing device and other components around the photoconductor drum 1 are controlled in the step S28. Those control procedures ar well-known and description thereof is omitted. In addition, the subroutine for toner supply control (to be described below) is called in the step S29.

It is determined in the step S30 whether copy operation is completed or not. If it is not completed, the program returns to the main routine. If it is completed, the above stated power supplies 41 and 43 are turned off in the step S31 and the copy start flag is reset to 0. Subsequently in the step S32, it is determined whether the mode flag is 1 or not. If it is not 1, which means that copy operation in the standard copy mode is executed, the program proceeds to the step S34. On the other hand, if the mode flag is 1, which means that copy operation in the outline image forming mode is executed, the timer T0 is set in the step S33 and the program proceeds to the step S34.

It is determined in the step S34 whether any of the keys on the operation panel 100 is turned on or not. If any key is turned on, the timer T0 is reset in the step S35 and the program returns to the main routine. If any of the keys is not turned on, it is determined in the step S36 whether counting of the timer T0 comes to an end. If it comes to an end, the mode flag is reset to 0 in the step S37. Thus, if the outline image forming mode is selected and if any of the keys on the operation panel 100 is not turned on within a predetermined period set in the timer T0 after an end of copy operation, the standard copy mode is automatically selected. In this manner, inadvertent operation in the outline image forming mode can be prevented thereafter.

Figure 11:
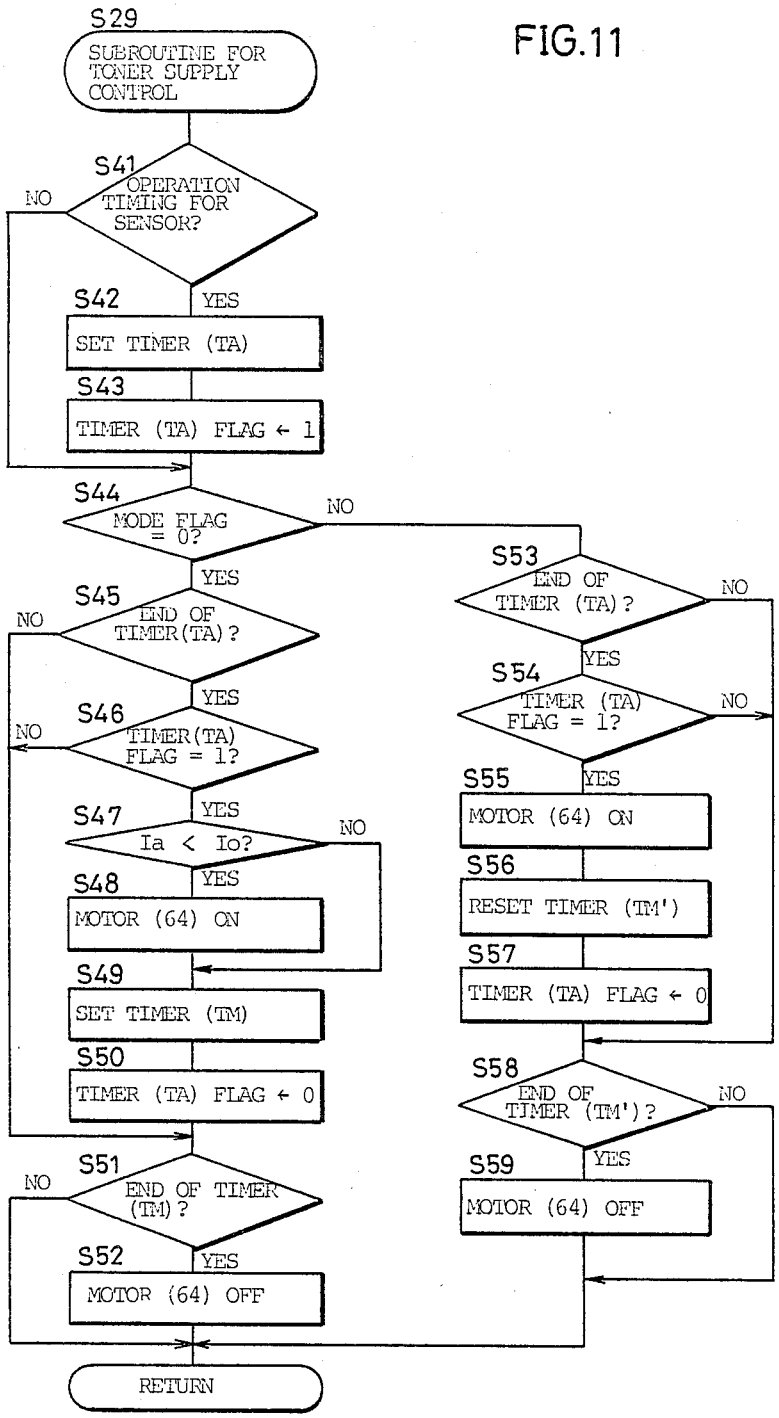

FIG. 11 shows the subroutine for toner supply control in the step S29. First, it is determined in the step S41 whether it is time for the sensor 37 to operate or not. If it is not the time, the program proceed to the step S44. If it is the time, the timer TA is set in the step S42 and the flag of the timer TA is set to 1 in the step S43, and then the program proceeds to the step S44. A value set in this timer TA is a period from the time when a reference image is formed on the surface of the photoconductor drum 1 to the time when the reference image attains a detection position of the toner density sensor 37 as a result, of rotation of the photoconductor drum 1.

It is determined in the step S44 whether the mode flag is 0 or not. If it is 0, that is, if the standard mode is selected, procedures in the steps S45 et seq. are executed. If it is 1, that is, if the outline image forming mode is selected, procedures in the steps S53 et seq. are executed.

If the standard copy mode is selected, the following procedures are executed. It is determined in the step S45 whether counting of the timer TA comes to an end or not, and it is determined in the step S46 whether the flag of the timer TA is 1 or not. If at least either of the two conditions is not satisfied, the program proceeds to the step S51. If both of the conditions are satisfied, that is, if the timer TA comes to an end, a toner density Ia detected by the toner density sensor 37 and a reference density Io are compared in the step S47. If the detected toner density Ia is higher than the reference density Io, the program proceeds to the step S49. If the detected toner density Ia is lower than the reference density Io, the toner supply motor 64 is turned on in the step S48 to start supply of toner, and then the program proceeds to the step S49.

A timer TM for determining a drive period of the motor 64 (i.e. a period for supply of toner) is set in the step S49 and the flag of the timer TA. is reset to 0 in the step S50. Then, the program proceeds to the step S51. The timer TM is set to a period terminated during copy operation of one sheet. This period is 4 seconds in this embodiment and toner of about 200 mg is supplied in this period.

Subsequently, it is determined in the step S51 whether the timer TM comes to an end or not. If it comes to an end, the motor 64 is turned off in the step S52 and the program returns to the subroutine of the step S5. If it does not come to an end, the procedures of the subroutine of the step S5 and the main routine are executed and the program returns to this subroutine for toner supply control. In this case, if it is determined that the condition in the step S41 is not satisfied, that the conditions in the steps S44 and S45 are satisfied and that the condition in the step S46 is not satisfied, it is determined again in the step S51 whether the timer TM comes to an end or not.

On the other hand, if the outline image forming mode is selected, the following procedures are executed. It is determined in the step S53 whether the timer TA set in the step S42 comes to an end or not, and it is determined in the step S54 whether the flag of the timer TA is 1 or not. If at least either of the two conditions is not satisfied, the program proceeds to the step S58. If both of the conditions are satisfied, that is, if the timer TA comes to an end, the motor 64 is turned on in the step S55 to start supply of toner. Then, in the step S56, the timer TM' for determining a drive period of the motor 64 (i.e. a period for supply of toner) is set in the step S56, and the flag of the timer TA is reset to 0 in the step S57. Then the program proceeds to the step S58. The set period of the timer TM' is considerably shorter than that of the above stated timer TM. In this embodiment, the set period of the timer TM' is 0.4 sec. and toner of about 20 mg is supplied in this period. This supply of toner is effected constantly for each copy operation, irrespective of a signal level from the toner density sensor 37.

Subsequently, it is determined in the step S58 whether the timer TM' comes to an end or not. If it comes to an end, the motor 64 is turned off in the step S59 and the program returns to the subroutine in the step S5. If it does not come to an end, procedures in the subroutine of the step S5 and the main routine are executed and the program returns again to the subroutine for toner supply control. In this case, if it is determined that the conditions in the steps S41 and S44 are not satisfied, that the condition in the step S53 is satisfied and that the condition in the step S54 is not satisfied, it is determined again in the step S58 whether the timer TM' comes to an end or not.

More specifically, in the standard copy mode, turn-on and turn-off of the toner supply motor 64 are controlled based on the output of the toner density sensor 37. On the other hand, in the outline image forming mode, a small constant amount of toner is supplied irrespective of the output of the sensor 37. Since the reference image is formed only as a outline image in the outline image forming mode, little amount of toner adheres to the image. As a result, the toner density sensor 37 always determines that the toner density is low. However, if a small amount of toner is constantly supplied as in this embodiment, an excess of toner never occurs even if copy operation is continued in the outline image forming mode. The constant amount of supply of toner is about 20 mg as described above, which value is smaller than the average consumption of toner of 40 to 50 mg in the standard mode, because the outline image forming mode requires less consumption of toner as only outline portions are developed in this mode.

Figure 12:
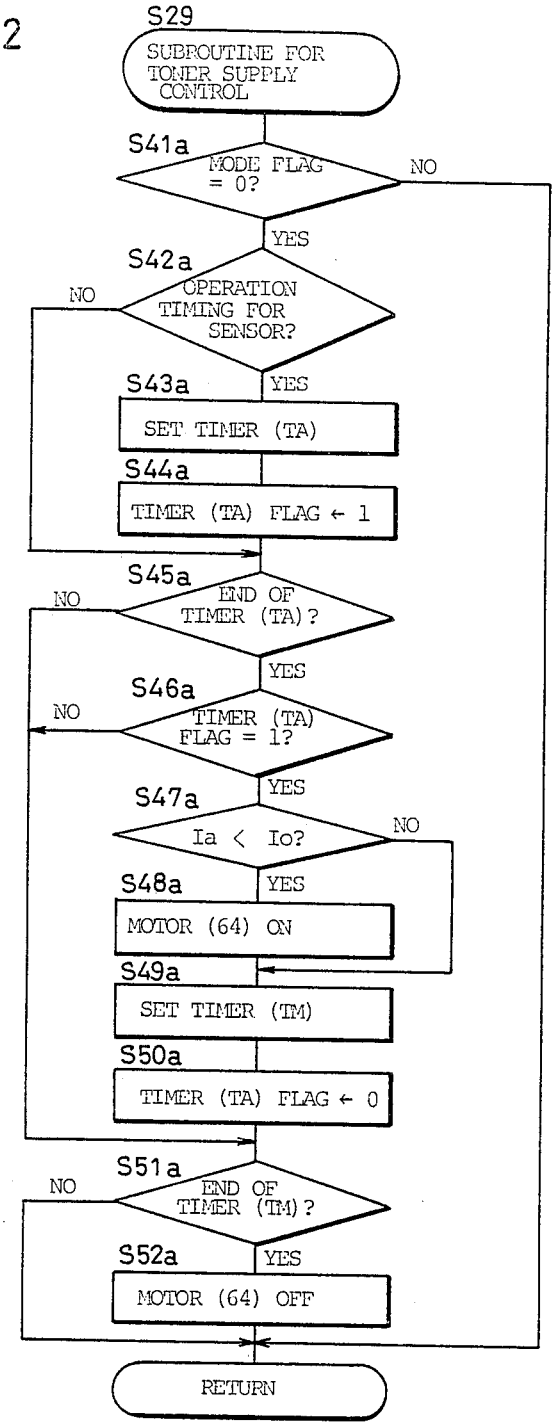
FIG. 12 is a flow chart corresponding to FIG. 11, showing control procedures of another embodiment.

OTHER EMBODIMENTS (A) A subroutine shown in FIG. 12 may be adopted for toner supply control processing executed in the step S29.

Referring to FIG. 12, first it is determined in the step S41*a* whether the mode flag is 0 or not. If it is 0, that is, if the standard copy mode is selected, procedures in the steps S42*a* et seq. are performed to control supply of toner. On the other hand, if the mode flag is 1, that is, if the outline image forming mode is selected, the program immediately returns to th subroutine of the step S5.

In the step S42*a*, it is determined whether it is time for the sensor 37 to operate or not. If it is not time for the sensor 37 to operate, the program proceeds to the step S45*a*. If it is time for the sensor 37 to operate, the timer TA is set in the step S43*a* and the flag of the timer TA is set to 1 in the step S44*a*. Then, the program proceeds to the step S45*a*. Thus, the timer TA is set to a period from the time when a reference image is formed on the surface of the photoconductor drum 1 to the time when the reference image attains a detection position of the toner density sensor 37 as a result of rotation of the photoconductor drum 1.

In the step S45*a*, it is determined whether the timer TA comes to an end or not. It is determined in the step S46*a* whether the flag of the timer TA is 1 or not. If at least either of the two conditions is not satisfied, the program proceeds to the step S51*a*. If both of the conditions are satisfied, the toner density Ia detected by the toner density sensor 37 and the reference density Io are compared in the step S47*a* when the timer TA comes to an end. If the toner density Ia is higher than the reference density Io, the program proceeds to the step S49*a*. If the toner density Ia is lower than the reference density Io, the toner supply motor 64 is turned on in the step S48*a* to start supply of toner. Then, the program proceed to the step S49*a*.

In the step S49*a*, the timer TM for determining a drive period of the motor 64 (i.e. a period for supply of toner) is set and the flag of the timer TA is reset to 0 in the step S50*a*. Then the program proceeds to the step S51*a*. The timer TM is set to a period to be terminated during copy operation of one sheet. In this embodiment, this period is 4 sec. and toner of about 200 mg is supplied in this period.

Subsequently, it is determined in the step S51*a* whether counting of the timer TM comes to an end or not. If it comes to an end, the motor 64 is turned off in the step S52*a* and the program returns to the subroutine of the step S5. If it does not come to an end, the procedures of the subroutine of the step S5 and the main routine are executed and the program returns again to the subroutine for toner supply control. In this case, if it is determined that the condition in the step S41*a* is satisfied, that the condition in the step S42*a* is not satisfied and that the condition in the step S45*a* is not satisfied, then, it is determined again in the step S51*a* whether counting of the timer TM comes to an end or not.

More specifically, in the standard copy mode, turn-on and turn-off of the toner supply motor 64 are controlled based on the output of the toner density sensor 37. On the other hand, in the outline image forming mode, toner is not supplied irrespective of the output of the sensor 7. Since the reference image is formed only as an outline image in this outline image forming mode, little amount of toner adheres and the toner density sensor 37 always determines that the toner density is low. However, if copy operation in the outline image forming mode is continued, excess of toner never occurs since toner is not supplied as described above.

Considering that toner is not supplied in the outline image forming mode, it might be feared that the toner density be excessively lowered if copy operation in this mode is continued. However, since only the outline portions are developed in the outline image forming mode, a very small amount of toner is consumed and, accordingly, if toner is not supplied, the toner density is not lowered to such a degree as to cause unfavorable influence to the copy image.

(B) Although a DC voltage is applied to the scorotron-charger 4 in the above described embodiment, an AC power supply 41' may be connected to the scorotron-charger 4 to apply an AC voltage thereto.

Figure 13:
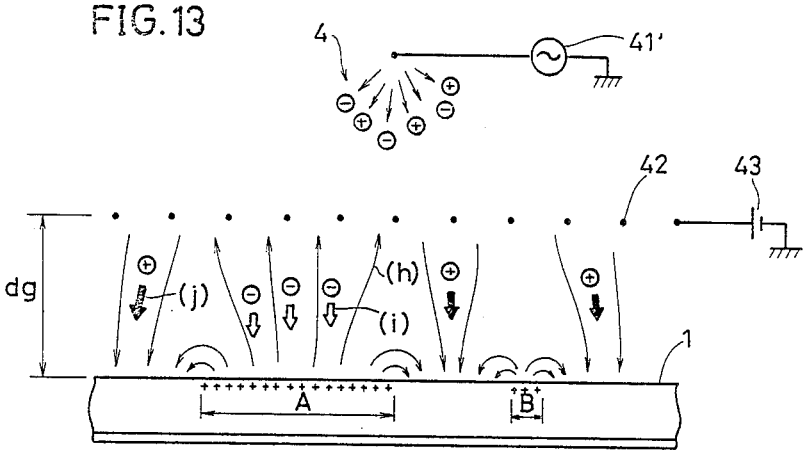
FIG. 13 is an illustration corresponding to FIG. 6, showing a further embodiment.
Figure 14A:
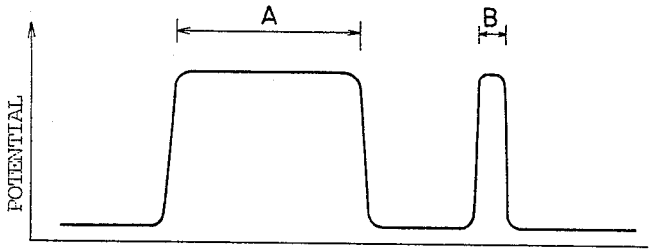
FIGS. 14A to 14C are graphs in the embodiment of FIG. 13, corresponding to FIGS. 7A to 7C.
Figure 14B:
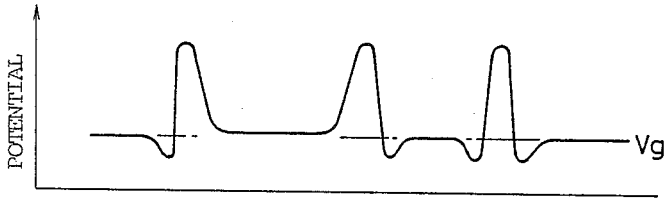
Figure 14C:
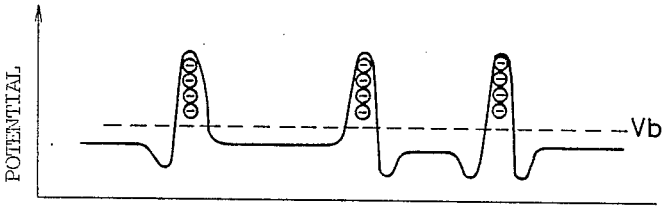
Figure 15:
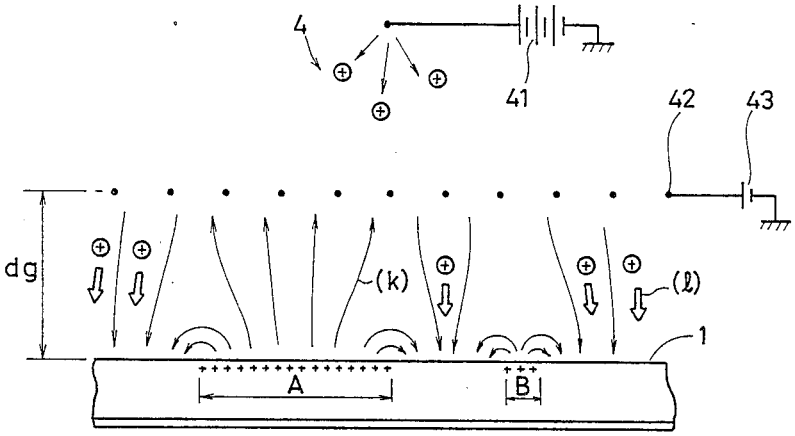
FIG. 15 is an illustration corresponding to FIG. 6, showing a further embodiment.

FIG. 13 shows a typical view of electric force lines in this case. FIG. 14A shows potential of an electrostatic latent image in the exposure step; FIG. 14B shows potential of the electrostatic latent image in the second charging step; and FIG. 14C shows potential of the electrostatic latent image in the developing step.

In the second charging step in this case, the surface of the photoconductor drum 1 on which the electrostatic latent image is formed in the exposure step is recharged by using the scorotron-charger 4, which is supplied with the AC voltage. At this time, the grid 42 is charged with a voltage of +200 V from the power supply 43. The voltage applied to the grid 42 is sufficiently lower than the surface potential of +600 V in the electrostatic latent image areas A and B and higher than the surface potential of +100 V in the non-image background areas. The voltage applied to the grid 42 is, however, of the same polarity as that in the first charging step.

There are lines of electrical force as schematically shown by arrows h in FIG. 13 between the surface of the drum 1 and the grid 42. Negative and positive ions issuing from the charge wire supplied with the AC voltage are subjected to conveying forces along these lines of electric force. In this case, the effective lines of force for accelerating negative ions in proximity of the grid 42 towards the surface of the drum 1 only exist inside the peripheral outlines of these image areas A and B. Therefore, these negative ions, as shown by double-lined arrows i similarly to the foregoing first embodiment, impinge exclusively upon the central portion of the image areas A and B devoid of inside peripheral zones of these image areas. As a result, the electrostatic potential level in these ion-impinged image areas will be caused to decrease to a low level which corresponds substantially to the grid voltage of +200 V, as shown by Vg in FIG. 14B.

On the other hand, the positive ions will go ahead, as shown by thickened small arrows j, towards the non-image background areas exclusive of the outline portion of the image area A for elevating the prevailing electrical charges thereat, thereby the corresponding potential elevating to a level nearly equal to the grid voltage of +200 V.

In other words, the drum surface potential prevailing at inside peripheries along the image areas A and B remains at the initial high voltage level substantially equal to +600 V and with a substantially constant width. The potential at substantive part of the image area A is lowered to a potential level substantially equal to the grid voltage Vg of +200 V. The non-image marginal portions per se remain at a certain lower potential level, nearly +100 V, while in other non-image areas, the potential will rise to nearly the grid voltage Vg of +200 V. The surface potential in the other strip-shaped image area B will hardly be lowered, the width of the charged portion being reduced to a certain degree.

Thus, in this second charging step, the peripheral outlines of those image areas A and B will be formed in the shape of statically positive latent images, also in the case of the present second embodiment.

(C) Instead of the above described embodiments, a construction shown in FIGS. 15 and 16A to 16C may be adopted.

In this case, a voltage applied to the grid 42 has the same polarityaas that of the charging voltage and voltages in outline portions are lower than the voltage in the other portions.

In this case, first the photoconductor drum 1 is charged at a predetermined potential level of +600 V.

Figure 16A:
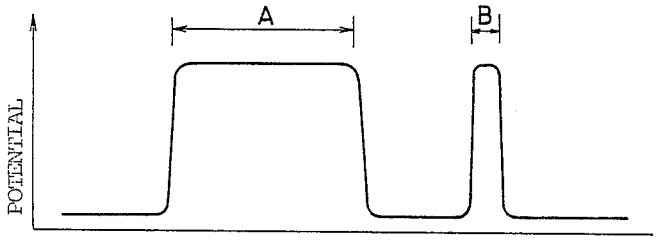
FIGS. 16A to 16C are graphs in the embodiment of FIG. 15, corresponing to FIGS. 7A to 7C.

The drum 1 is then exposed to a positive original image to form an electrostatic latent image thereon as shown in FIG. 16A. In this case, the image areas A and B are of +600 V, while the non-image areas are of +100 V.

Figure 16B:
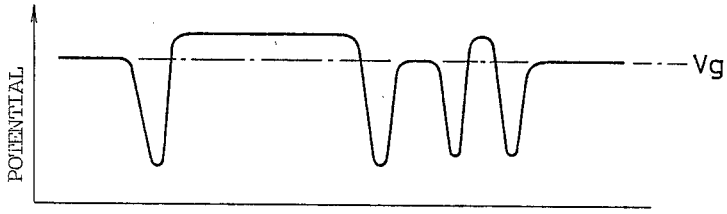

The drum 1 is recharged by the scorotron-charger 4 upon execution of the exposure. The charge at the scorotron-charger 4 is of the same polarity as that adopted in the first charging, while the voltage applied to the grid 42 is slightly lower than that prevailing in the image areas, and sufficiently higher than that prevailing in the non-image areas. The voltage of +500 V is applied to the grid 42. As a result, the non-image areas devoid of the outline portions of the image areas are considerably elevated nearly to the grid potential of +500 V. Therefore, the outline portions have a potential lower than the potential of the other portions, as shown in FIG. 16B.

Figure 16C:
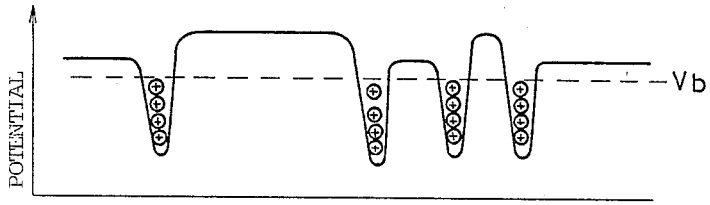
Figure 17:
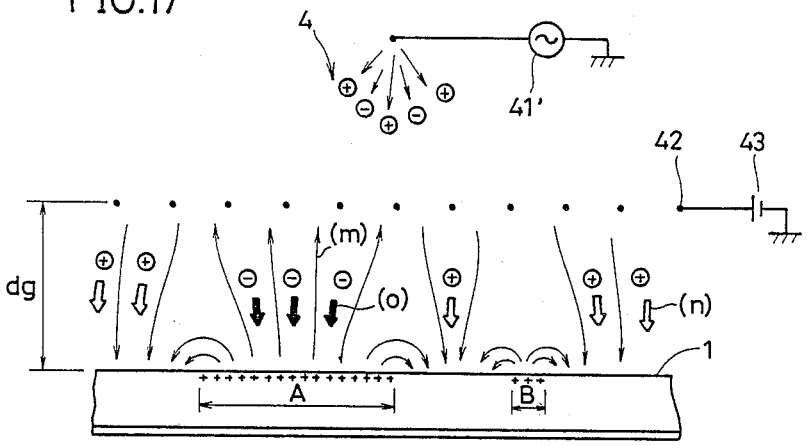
FIG. 17 is an illustration corresponding to FIG. 6, showing a still further embodiment.

The negative outline images thus formed are developed by a reversal development. More specifically, the positively charged toner particles will be deposited onto only the lower potential portions, i.e., the outline portions as shown in FIG. 16C by applying, for example, a voltage of +400 V as a developing bias voltage. This developing bias voltage is selected to be slightly lower than the grid voltage for preventing superfluous and fouling toner deposition not only in the non-image areas but also in the image areas.

Figure 18A:
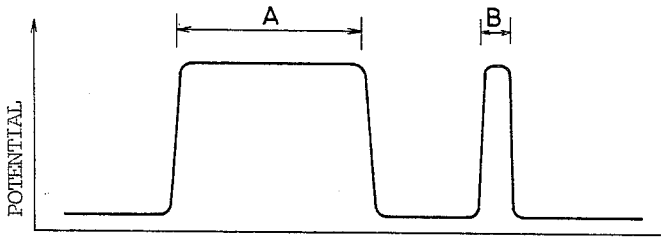
FIGS. 18A to 18C are graphs in the embodiment of FIG. 17, corresponding to FIGS. 7A to 7C.
Figure 18B:
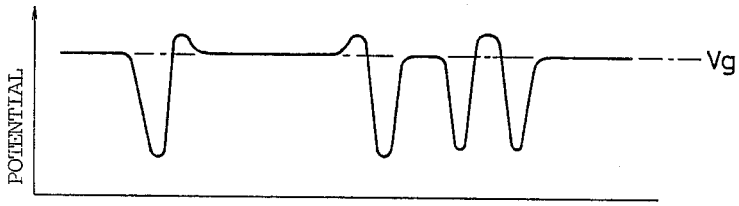
Figure 18C:
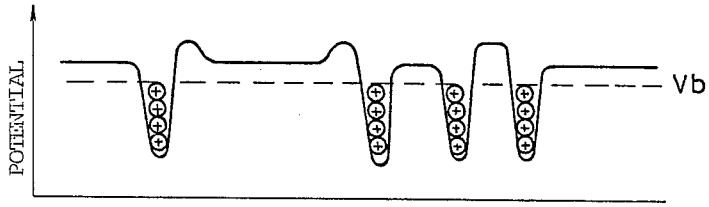

In addition, in this embodiment, an AC power supply 42' may be connected to the scorotron-charger 4 to apply an AC voltage thereto. Potentials of an electrostatic latent image in the image forming steps in this case are shown in FIGS. 18A to 18C.

(D) The present invention may be applied to a construction for forming a positive outline image from a negative original image.

In this case, a voltage applied to the grid 42 is for example lower than the voltage in the non-image areas and higher than that in the image areas.

(E) An electrophotographic copying apparatus according to the present invention is not limited to the above described embodiments and various variants may be adopted within the scope of the present invention. Particularly, various types may be adopted as the developing device 5. For example, the developing bias voltage may be applied by overlapping a DC voltage with an AC voltage. Particularly, the voltage thus obtained is effective in the case of using magnetic insulating toner. In such a case, using magnetic insulating toner, magnetic attraction force is generated besides the developing bias voltage value Vo and accordingly the developing bias voltage value Vb in the outline image forming mode in the first embodiment for example can be set to a value a little lower than the surface potential of the central portion of the image area A where potential is lowered in the second charging step.

As can be seen from the foregoing description, the present invention uses the second control means for controlling the amount of toner to be replenished to the developing means to cause the amount to be smaller than the amount determined dependent on the result of detection of the detecting means when the second copying mode is designated. Thus, superfluous toner will never be caused if copy operation is continued in the second copying mode requiring little consumption of toner. Consequently, it becomes possible to prevent disadvantages such as stains in the copy image or splashes of toner to soil the environmental equipment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus comprising:

an electrostatic latent image bearing member;

first charging means for charging the electrostatic latent image bearing member;

exposing means for exposing the charged electrostatic latent image bearing member to light reflected from an original, thereby to form an electrostatic latent image thereon;

second charging means for recharging the electrostatic latent image bearing member on which the electrostatic latent image is formed to obtain an outline image;

developing means for developing the electrostatic latent image;

means for forming a reference image on the electrostatic latent image bearing member;

detecting means for detecting an amount of toner adhering to said reference image;

mode designating means for designating either a first copying mode in which said second charging means is not operated or a second copying mode in which said second charging means is operated;

first control means for controlling an amount of toner to be replenished to the developing means dependent on the result of detection of said detecting means, when said first copying mode is designated; and second control means for controlling an amount of toner to be replenished to the developing means to cause said amount to be smaller than the amount determined dependent on the result of detection of said detecting means, when said second copying mode is designated.

2. An electrophotographic copying apparatus as defined in claim 1, wherein said amount of toner to be replenished when said second copying mode is designated includes zero.

3. An electrophotographic copying apparatus as defined in claim 2, wherein said amount of toner to be replenished when said second copying mode is designated is predetermined and fixed.

4. An electrophotographic copying apparatus as defined in claim 3, wherein said second control means comprises timer means for computing time when the toner is replenished to said developing means.

5. An electrophotographic copying apparatus as defined in claim 4, wherein said amount of toner to be replenished when said second copying mode is designated is about 20 mg.

6. An electrophotographic copying apparatus as defined in claim 2, wherein said second charging means has a scorotron-charger provided with a grid.

7. An electrophotographic copying apparatus as defined in claim 6, wherein said scorotron-charger has a polarity opposite to that of said first charging means.

8. An electrophotographic copying apparatus as defined in claim 7, wherein said grid is supplied with a voltage which is sufficiently lower than a surface potential in an image area of the electrostatic latent image and slightly higher than a surface potential in a non-image area of the electrostatic latent image with the same polarity as that of the first charging means, so that only an outline portion has a higher potential.

9. An electrophotographic copying apparatus as defined in claim 8, wherein the developing means is supplied with a bias voltage which is slightly higher than the voltage applied to said grid when said second copying mode is designated.

10. An electrophotographic copying apparatus as defined in claim 9, wherein the first control means replenishes toner to the developing means when the amount of toner detected by the detecting means falls below a reference amount of toner.

11. An electrophotographic copying apparatus as defined in claim 6, wherein said scorotron-charger is supplied with an alternating voltage.

12. An electrophotographic copying apparatus as defined in claim 11, wherein said grid is supplied with a voltage which is sufficiently lower than the surface potential in an image area of the electrostatic latent image and slightly higher than the surface potential in a non-image area of the electrostatic latent image with the same polarity as that of the first charging means, so that only an outline portion has a higher potential.

13. An electrophotographic copying apparatus as defined in claim 6, wherein said scorotron-charger has the same polarity as that of said first charging means.

14. An electrophotographic copying apparatus as defined in claim 11 or claim 13, wherein said grid is supplied with a voltage which is slightly lower than the surface potential in an image area of the electrostatic latent image and sufficiently higher than the surface potential in a non-image area of the electrostatic latent image with the same polarity as that of the first charging means, so that only an outline portion has a lower potential.

15. An electrophotographic copying method comprising:

a first charging step of charging an electrostatic latent image bearing member;

an exposing step of exposing the charged electrostatic latent image bearing member to light reflected from an original, thereby to form an electrostatic latent image thereon;

a second charging step of recharging the electrostatic latent image bearing member on which the electrostatic latent image is formed to obtain an outline image;

a developing step of developing the electrostatic latent image;

a step of forming a reference image on the electrostatic latent image bearing member;

a detecting step of detecting an amount of toner adhering to said reference image;

a mode designating step of designating either a first copying mode in which said second charging step is no applied or a second copying mode in which said second charging step is applied;

a first control step of controlling an amount of toner to be replenished for the developing step of the electrostatic latent image dependent on the result of detection of the detecting step, when said first copying mode is designated; and a second control step of controlling an amount of toner to be replenished for the developing step of the electrostatic latent image to cause said amount to be smaller than the amount determined dependent on the result of detection of said detecting step, when said second copying mode is designated.

16. An electrophotographic copying method as defined in claim 15, wherein said amount of toner to be replenished when said second copying mode is designated includes zero.

17. An electrophotographic copying method as defined in claim 16, wherein said amount of toner to be replenished when said second copying mode is designated is predetermined and fixed.

18. An electrophotographic copying method as defined in claim 17, wherein said amount of toner to be replenished when said second copying mode is designated is about 20 mg.

* * * * *

UNITED STATES PATENT AND TRADEMARK OFFICE

CERTIFICATE OF CORRECTION

PATENT NO. : 4,785,331

DATED : November 15, 1988

INVENTOR(S) : Tateki OKA et al.

It is certified that error appears in the above-identified patent and that said Letters Patent is hereby corrected as shown below:

In the heading, line 73, read

Assignee: Minolta Camera Kabushiki Kaisha, Osaka, Japan

Signed and Sealed this

Eighth Day of August, 1989

*Attest:*

*Attesting Officer*

DONALD J. QUIGG

*Commissioner of Patents and Trademarks*